US011965655B2

(12) United States Patent
Lee et al.

(10) Patent No.: US 11,965,655 B2
(45) Date of Patent: Apr. 23, 2024

(54) COOKING APPLIANCE AND CONTROL METHOD THEREOF

(71) Applicant: LG ELECTRONICS INC., Seoul (KR)

(72) Inventors: Changuk Lee, Seoul (KR); Seungtae Jang, Seoul (KR); Siyoung Ryu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 373 days.

(21) Appl. No.: 17/167,525

(22) Filed: Feb. 4, 2021

(65) Prior Publication Data

US 2021/0262671 A1 Aug. 26, 2021

(30) Foreign Application Priority Data

Feb. 20, 2020 (KR) ..... 10-2020-0021279

(51) Int. Cl.
*F24C 15/00* (2006.01)
*F24C 7/08* (2006.01)

(52) U.S. Cl.
CPC ..... *F24C 15/006* (2013.01); *F24C 7/085* (2013.01)

(58) Field of Classification Search
CPC ..... F24C 15/006; F24C 7/085
USPC ..... 126/198
See application file for complete search history.

(56) References Cited

U.S. PATENT DOCUMENTS

| | | | | |
|---|---|---|---|---|
| 2005/0077288 | A1* | 4/2005 | Gerl | F24C 15/2007 219/620 |
| 2007/0278215 | A1* | 12/2007 | Schilling | H05B 6/1263 219/622 |
| 2008/0130225 | A1* | 6/2008 | Gilliland | H05K 7/20154 361/695 |
| 2009/0167228 | A1* | 7/2009 | Chung | F04D 27/004 318/473 |
| 2013/0025364 | A1 | 1/2013 | Bach | |
| 2015/0369491 | A1* | 12/2015 | Estrella | F24C 15/006 126/21 A |
| 2020/0408419 | A1* | 12/2020 | Diehl | F24C 15/101 |

FOREIGN PATENT DOCUMENTS

| | | | |
|---|---|---|---|
| DE | 10128370 | B4 | 12/2011 |
| EP | 0579074 | A1 | 1/1994 |
| EP | 1457740 | B1 | 3/2003 |
| EP | 0833108 | B1 | 4/2003 |
| EP | 1816402 | A2 | 8/2007 |
| EP | 3933275 | A1 | 6/2021 |

* cited by examiner

*Primary Examiner* — Avinash A Savani
(74) *Attorney, Agent, or Firm* — Bryan Cave Leighton Paisner LLP

(57) ABSTRACT

The present disclosure relates to a cooking appliance and a control method thereof. The cooking appliance and control method thereof are characterized in that a temperature measuring part is installed in a supporter configured to support a circuit board, a cool air passage is formed between a cavity and the circuit board, and the temperature measuring part measures a temperature in the cool air passage.

16 Claims, 7 Drawing Sheets

COOKING APPLIANCE AND CONTROL METHOD THEREOF

CROSS-REFERENCE TO RELATED APPLICATION

This application claims priority to and the benefit of Korean Patent Application No. 10-2020-0021279, filed in Korea on Feb. 20, 2020, the disclosure of which is incorporated herein by reference in its entirety.

FIELD

Disclosed here is a cooking appliance, and more particularly, a cooking appliance and a control method thereof in which various electronic components are disposed in an electronic component space.

BACKGROUND

Cooking appliances are used to cook food, and are installed in the kitchen to cook food according to a user's intention. The cooking appliances can be classified in various ways, based on a heat source or a type, and the sort of fuel.

Additionally, the cooking appliances can be divided into an open type cooking appliance in which food is placed in an open space, and a sealed type cooking appliance in which food is placed in a closed space, based on a way of cooking food. The sealed type cooking appliance includes an oven, a microwave oven and the like. The open type cooking appliance includes a cooktop, a hob, a griddle and the like.

In the sealed type cooking appliance, a space, in which food is placed, is shielded, and the shielded space is heated to cook food. The sealed type cooking appliance is provided with a cooking space in which food is placed and which is shielded when the food is cooked. The cooking space is a space in which food is substantially cooked.

The sealed type cooking appliance is provided with a door that optionally opens and closes the cooking space in a swivable manner. The door is installed in a main body in a swivable manner by a door hinge provided between the main body, having the cooking space therein, and the door, and swivels with respect to a portion where the door and the main body are coupled through the door hinge to optionally open and close the cooking space.

A heat source is included in the cooking space opened and closed by the door, to heat the cooking space. The heat source includes a gas burner or an electric heater and the like.

The cooking space includes an electronic component space in an upper portion thereof. In the electronic component space, electronic components required for operating the sealed type cooking appliance can be disposed. The electronic component space is formed as a space separate from the cooking space.

In the electronic component space, a cooling fan for cooling the electronic component space is disposed. The cooling fan can be provided in the form of a centrifugal fan such as a sirocco fan, and can be disposed eccentrically to a rear of the electronic component space. The cooling fan can suction external air to cool an inside of the electronic component space and can forcibly blow hot air in the electronic component space out of the sealed type cooking appliance to cool the electronic component space.

When the cooling fan is out of order, the electronic component space cannot cool properly. This causes an excessive increase in temperatures of electronic components in the electronic component space and failure of the electronic components.

SUMMARY

Technical Problem

The object of the present invention is to provide a cooking appliance and a control method thereof that may have an improved structure to rapidly determine whether a cooling fan fails or not.

Another object is to provide a cooking appliance and a control method thereof that may have an improved structure to prevent failure of electronic components, caused by overheat.

Technical Solution

To achieve the above aims, in a cooking appliance according to one embodiment, a temperature measuring part may be installed in a supporter configured to support a circuit board, a cool air passage may be formed between a cavity and the circuit board, and the temperature measuring part may measure a temperature in the cool air passage.

Based on results of the temperature measuring part's measurement, failure of the cooling fan may be rapidly determined.

According to another embodiment, when a temperature of the cool air passage formed between the cavity and the circuit board exceeds a predetermined temperature, a cooking operation of the cooking appliance may stop.

Since the failure of the cooling fan is rapidly determined and the cooking operation stops, failure of electronic components, caused by overheat, may be prevented.

In a control method of a cooking appliance according to another embodiment, it may be determined whether an operation of the cooling fan is stopped, based on results of the measurement of the temperature in the cool air passage, and when it is determined that the operation of the cooling fan is stopped, a cooking operation may stop.

A cooking appliance according to an aspect, including a cavity provided with a cooking space therein and an electronic component space provided outside the cavity, includes: a circuit board disposed in the electronic component space; a supporter configured to space the circuit board from the cavity and support the circuit board; a temperature measuring part installed in the supporter and supported by the supporter; and a cooling fan configured to generate a flow of cool air passing through the electronic component space, wherein the cooling fan generates a flow of cool air passing through a cool air passage that is an area surrounded by the cavity, the circuit board and the supporter, and the temperature measuring part measures a temperature in the cool air passage.

The temperature measuring part may be disposed between the cavity and the circuit board, for example.

The electronic component space may be disposed in an upper side of the cavity, the supporter may include an air guide disposed in a lateral side of the circuit board, configured to protrude upward from the cavity and configured to block a lateral side of the cool air passage, and the temperature measuring part may be installed in the air guide, for example.

The temperature measuring part may be disposed between the cavity and the circuit board, and a front-rear position of the temperature measuring part may overlap a position of the circuit board, for example.

The electronic component space may be disposed in the upper side of the cavity, a door may be disposed at a front of the cavity, the cooling fan may be disposed at a rear of the door, and the temperature measuring part may be disposed between the door and the cooling fan, for example.

The temperature measuring part may be disposed closer to the door than to the cooling fan, for example.

The cooking appliance may further include a front panel which is disposed between the cavity and the door and at least a portion of which blocks a front of the electronic component space, the front panel may have an inlet, and the temperature measuring part may be disposed between the inlet and the cooling fan and spaced rearward from the inlet by a predetermined distance or greater, for example.

The predetermined distance may be a distance between the cavity and the circuit board spaced from each other, or greater, for example.

The cooking appliance may further include a controller configured to control a cooking operation of the cooking appliance, and the controller may stop a cooking operation of the cooking appliance when a temperature measured by the temperature measuring part exceeds a predetermined temperature, for example.

The predetermined temperature may be a highest temperature among temperatures that are measured by the temperature measuring part during an operation of the cooling fan, for example.

The temperature measuring part may include a thermistor installed in the supporter and configured to measure a temperature in the cool air passage, for example.

A control method of a cooking appliance according to another aspect, includes: measuring a temperature in the cool air passage; determining whether an operation of the cooling fan is stopped based on a result of the measurement of the temperature in the cool air passage; and stopping a cooking operation of the cooking appliance when it is determined that the operation of the cooling fan is stopped, for example.

The cooking appliance may include a heating part configured to heat the cooking space, and when a temperature measured by the temperature measuring part exceeds the predetermined temperature, it may be determined that an operation of the cooling fan is stopped, and the heating part may stop operating, for example.

Advantageous Effect

In the cooking appliance and the control method thereof according to the present disclosure, the failure of the cooling fan is determined based on results of the temperature measuring part's measurement of temperature. Accordingly, the failure of the cooling fan may be rapidly determined.

Additionally, the cooking appliance according to the present disclosure may rapidly determine whether the electronic components cool properly or not and may stop a cooking operation, when the electronic components do not cool properly due to the failure of the cooling fan, thereby preventing the electronic components from overheating and failing.

BRIEF DESCRIPTION OF DRAWING

The accompanying drawings constitute a part of this specification, illustrate one or more embodiments of the present disclosure, and together with the specification, explain the present disclosure, wherein.

DETAILED DESCRIPTION

Figure 1:
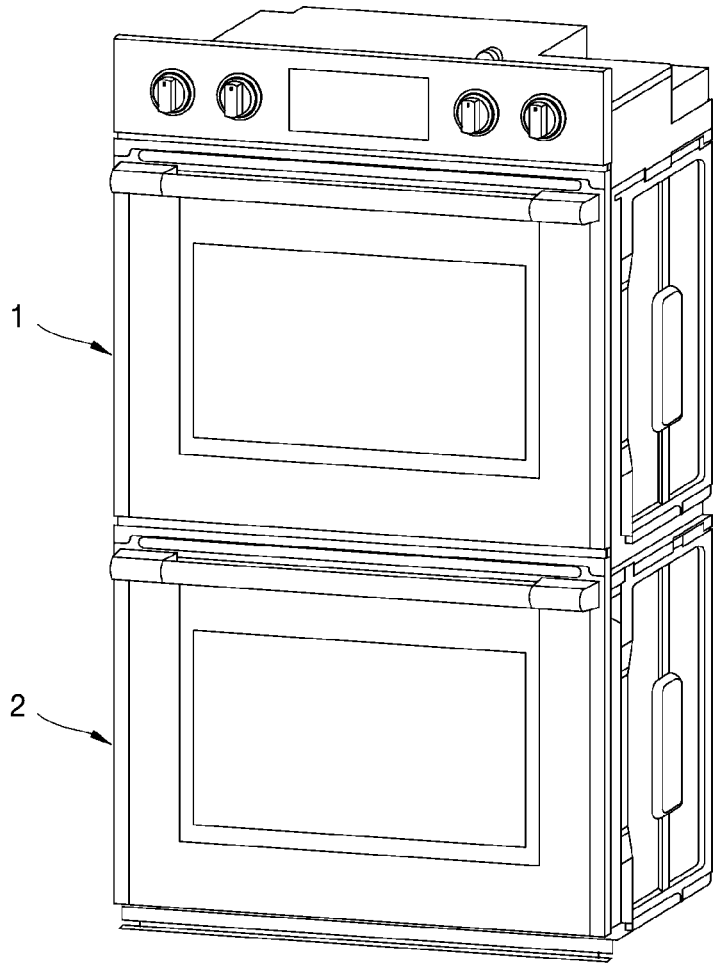
FIG. 1 is a front perspective view showing a cooking appliance according to an embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When one component is described as being "in an upper portion (or a lower portion)" of another component, or "on (or under)" another component, one component can be placed on the upper surface (or under the lower surface) of another component, and an additional component may be interposed between another component and one component on (or under) another component.

When one component is described as being "connected", "coupled", or "connected" to another component, one component can be directly connected, coupled or connected to another component. However, it is also to be understood that an additional component can be "interposed" between the two components, or the two components can be "connected", "coupled", or "connected" through an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "have" and the like, set forth herein, are not interpreted as necessarily including all the stated components or steps but can be interpreted as including some of the stated components or steps or can be interpreted as further including additional components or steps.

Throughout the disclosure, the terms "A and/or B" as used herein can denote A, B or A and B, and the terms "C to D" can denote C or greater and D or less, unless stated to the contrary.

[Entire Structure of Cooking Appliance]

Figure 2:
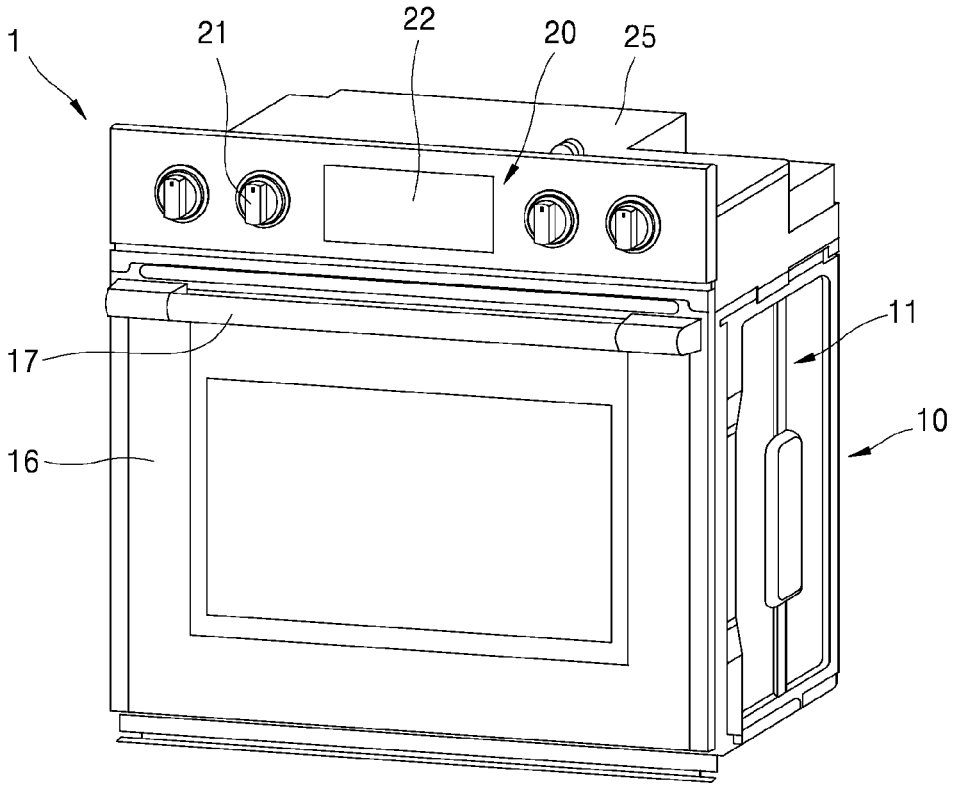
FIG. 2 is a front perspective view showing a part separated from the cooking appliance in FIG. 1.
Figure 3:
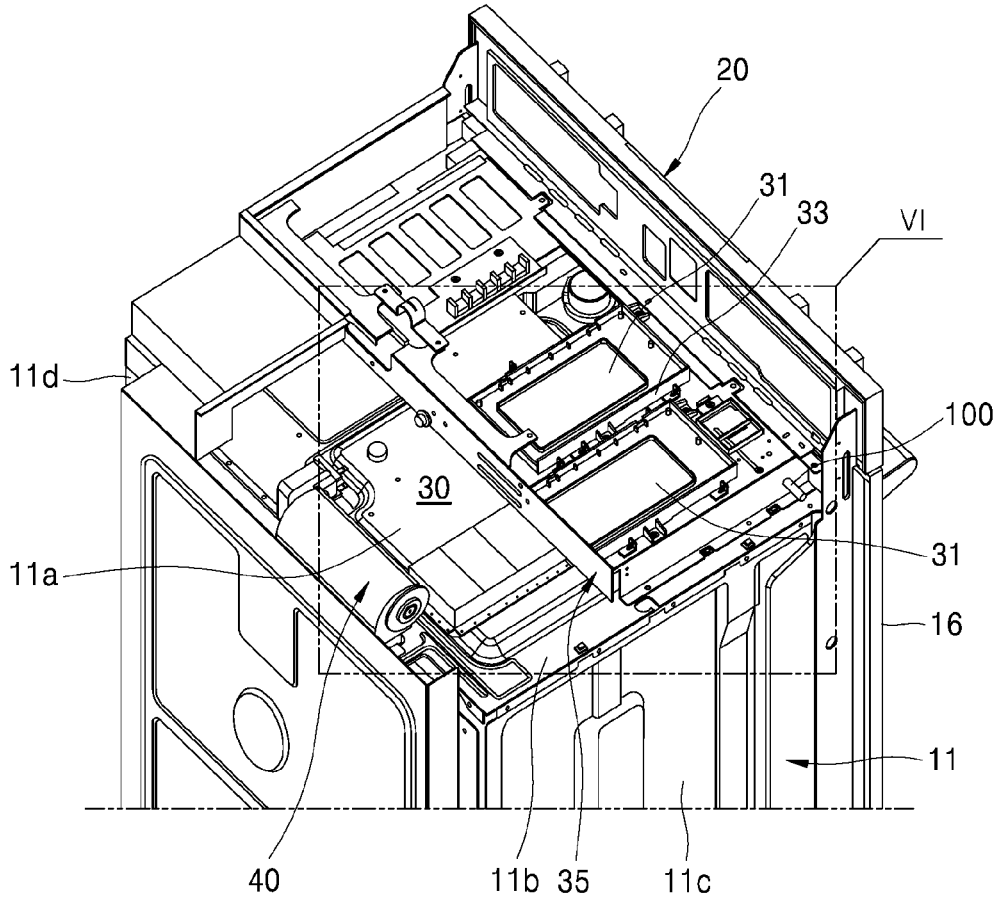
FIG. 3 is a rear perspective view showing the cooking appliance in FIG. 2.
Figure 4:
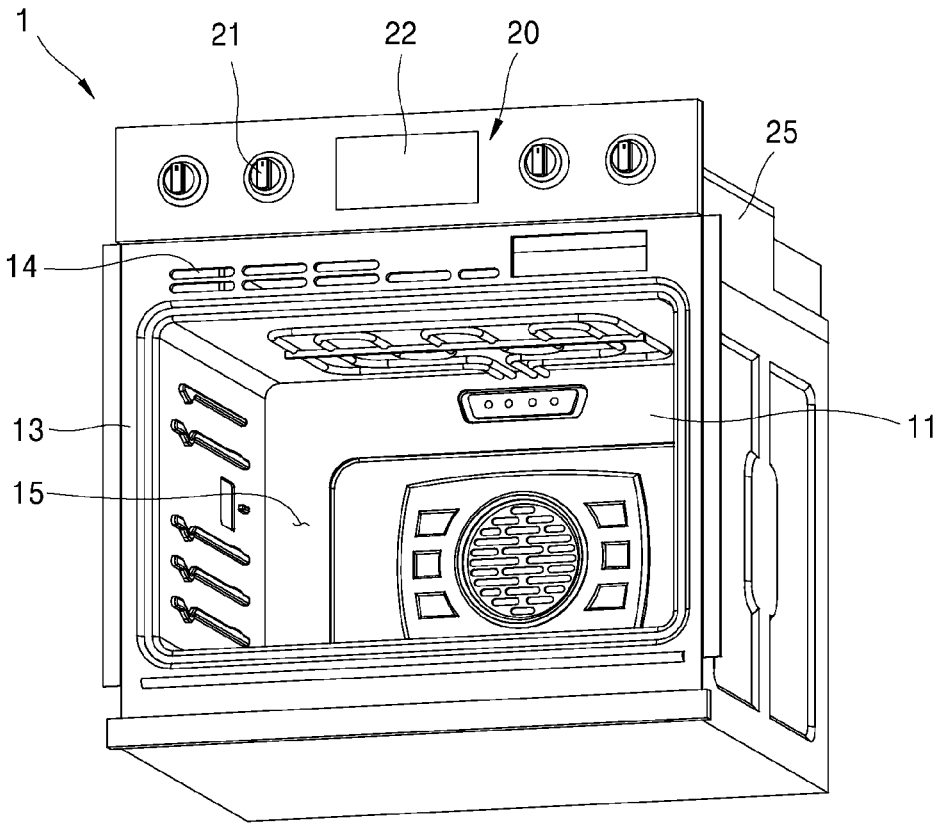
FIG. 4 is a front perspective view showing the cooking appliance in FIG. 3 without a door.

FIG. 1 is a front perspective view showing a cooking appliance according to an embodiment, and FIG. 2 is a front perspective view showing a portion separated from the cooking appliance in FIG. 1. FIG. 3 is a rear perspective view showing the cooking appliance in FIG. 2, and FIG. 4 is a front perspective view showing the cooking appliance in FIG. 3 without a door.

Referring to FIG. 1, a cooking appliance according to an embodiment may include a first unit 1 in an upper side of the cooking appliance, and a second unit 2 in a lower side of the cooking appliance.

In the embodiment, the first unit 1 and the second unit 2 may all be a sealed-type cooking appliance such as an electric oven, but not limited.

For example, the cooking appliance may include an electric oven as the first unit 1 in the upper side thereof, and a gas oven as the second unit 2 in the lower side thereof. On the contrary, the cooking appliance may include a gas oven as the first unit 1 in the upper side thereof, and an electric oven as the second unit 2 in the lower side thereof.

In another example, instead of an oven, another type of sealed-type cooking appliance such as a microwave oven may be used as the first unit 1 or the second unit 2, or an open-type cooking appliance such as a cooktop, a hob, a griddle and the like may be used as the first unit 1 and disposed onto the second unit 2.

Below, a configuration of a cooking appliance including electric ovens as the first unit 1 and the second unit 2 is described as an example. In the description, a configuration of the first unit 1 is mainly described.

Referring to FIGS. 2 to 4, a main body 10 forms an exterior of the first unit 1. The main body 10 may have a shape including an approximate cuboid shape, and may be made of a material having predetermined strength to protect various components installed in an inner space thereof.

The main body 10 may include a cavity 11 forming a skeleton of the main body 10, and a front panel 13 disposed at a front of the cavity 11 and forming a front surface of the main body 10. The cavity 11 has a cooking space 15 therein, and an opening configured to open the cooking space 15 forward may be formed in the front panel 13.

The main body 10 may have the cooking space 15 therein. The cooking space 15 may have a hexahedron shape a front surface of which is open. With the cooking space 15 closed, an inner space of the cooking space 15 may be heated to cook food. That is, in the cooking appliance, the inner space of the cooking space 15 is a space where food is substantially cooked.

The cooking appliance may be provided with a heating part configured to heat the cooking space 15. For example, a convection part 18 may be provided as the heating part on a rear side of the cooking space 15. The convection part 18 may heat the inner space of the cooking space 15 as a result of convection of hot air. Additionally, an upper heater configured to heat the inner space of the cooking space 15 from an upper side of the cooking space 15 may be provided as the heating part on the upper side of the cooking space 11. A lower heater configured to heat the inner space of the cooking space 15 from a lower side of the cooking space 15 may be provided as the heating part on the lower side of the cooking space 15.

The main body 10 is provided with a door 16 configured to swivel and optionally open and close the cooking space 15, at a front thereof. The door 16 may be a pull-down type door that opens and closes the cooking space 15 in a way that an upper end of the door 16 swivels with respect to a lower end of the door 16 in an up-down direction.

The door 16 may have a hexahedron shape having a predetermined thickness as a whole, and may have a handle 17 on a front surface thereof. A user may grip the handle 17 to swivel the door 16.

A control panel 20 may be provided in an upper side of a front surface of the cooking appliance, i.e., on a front surface of an upper side of the cavity 11. The control panel 20 may form a portion of an exterior of the front surface of the cooking appliance. The control panel 20 may include a knob 21 for controlling an operation of the cooking appliance, and a display 22 configured to display an operation state of the cooking appliance and the like.

An electronic component space 30 is provided outside the cavity 11. The electronic component space 30 may be disposed in the upper side of the cavity 11 and behind the control panel 20. In the electronic component space 30, a space for installing electronic components is formed.

A front surface of the electronic component space 30 may be blocked by the front panel 13. The front panel 13 may be disposed between the cavity 11 and the door 16. The front panel 13 may be disposed such that at least a portion of the front panel 13 blocks a front of the electronic component space 30. For example, an upper area of the front panel 13 disposed in an upper side of the cooking space 15, may block the front surface of the electronic component space 30.

The front panel 13 may have an inlet 14. The inlet 14 may be formed on the front panel 13 and penetrate in a front-rear direction. A passage for introducing air outside the electronic component space 30 into the electronic component space 30 may be formed on the front panel 13 by the inlet 14.

[Inner Structure of Electronic Component Space]

Upper, lateral and rear boundary surfaces of the electronic component space 30 may be defined by an electronic component space cover 25 covering the electronic component space 30 from above. Additionally, the lower boundary surface the electronic component space 30 may be defined by an upper surface of the cavity 11.

Figure 5:
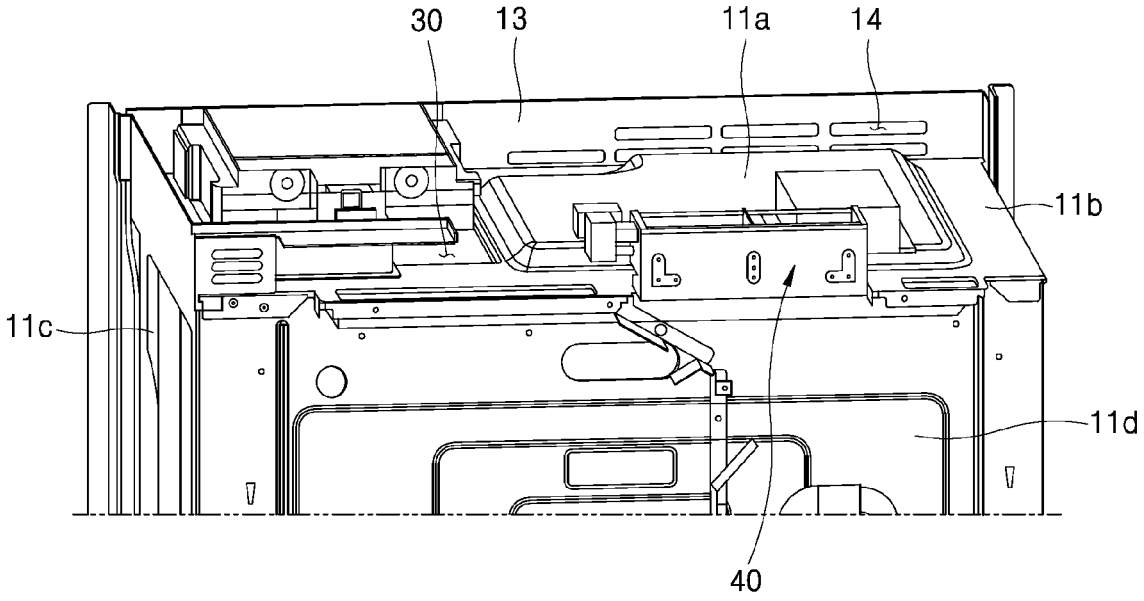
FIG. 5 is a rear perspective view showing the cooking appliance in FIG. 3 without some components.
Figure 6:
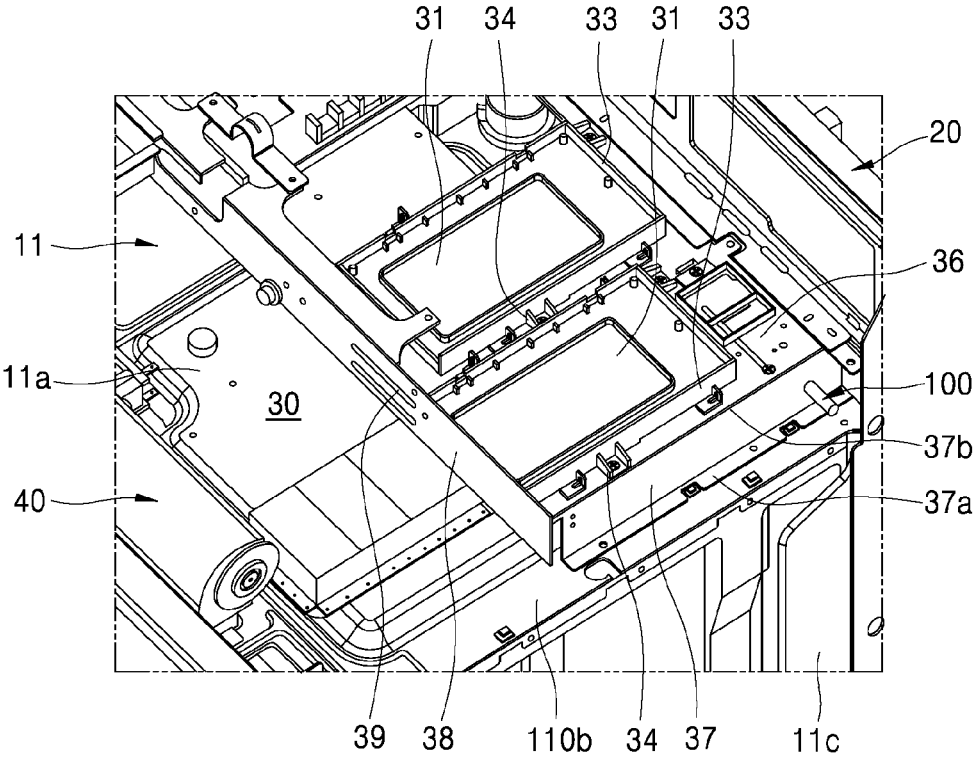
FIG. 6 is an enlarged rear perspective view showing the part of "VI" in FIG. 3.
Figure 7:
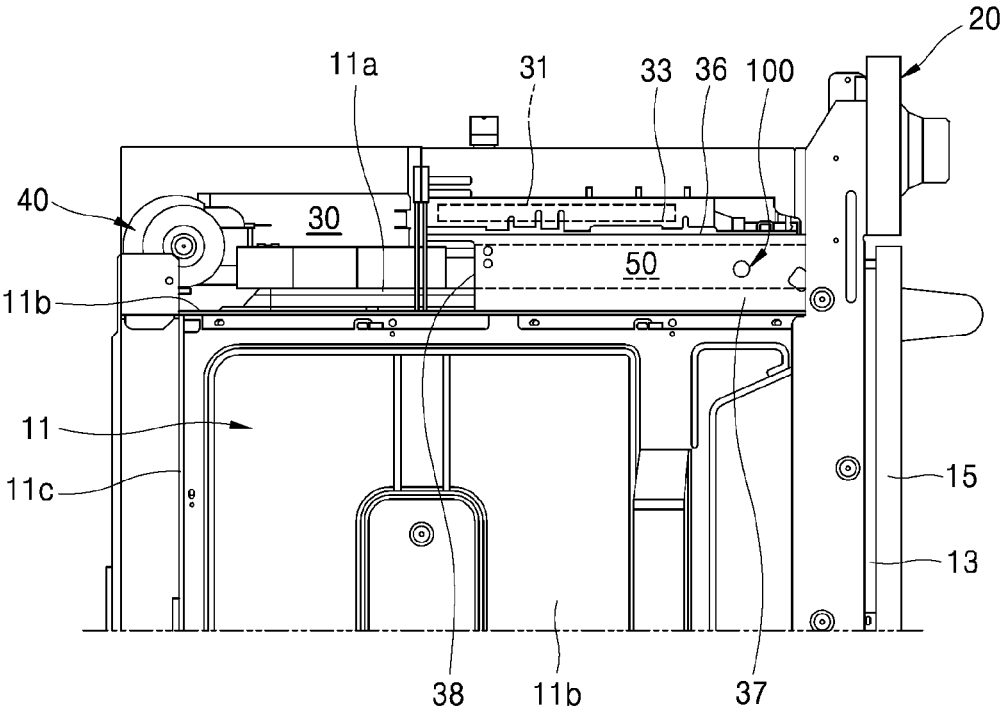
FIG. 7 is a side view showing the cooking appliance in FIG. 3.
Figure 8:
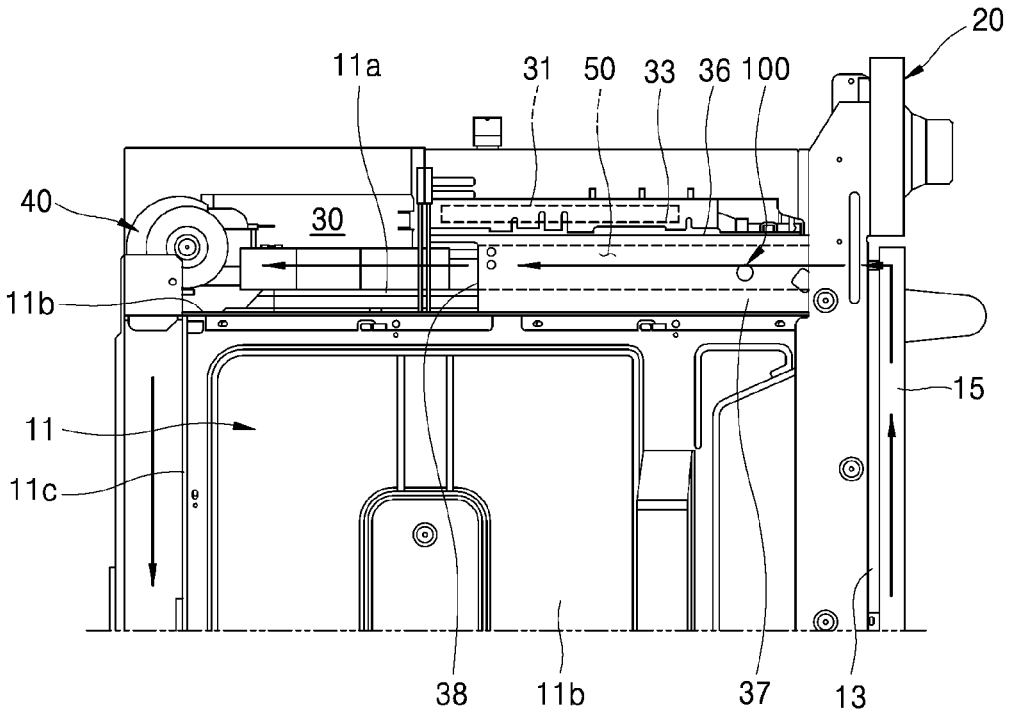
FIG. 8 is a view showing a flow of cool air in the cooking appliance of FIG. 7.

FIG. 5 is a rear perspective view showing the cooking appliance in FIG. 3 without some components, and FIG. 6 is an enlarged rear perspective view showing the part of "VI" in FIG. 3. FIG. 7 is a side view showing the cooking appliance in FIG. 3, and FIG. 8 is a view showing a flow of cool air in the cooking appliance of FIG. 7.

In FIG. 5, the electronic component space cover, a circuit board, a supporter and the like are omitted. In FIGS. 6 and 7, the electronic component space cover is omitted.

According to the embodiment, the upper surface of the cavity 11 may include a first area 11*a*, and a second area 11*b*, as illustrated in FIG. 5.

The first area 11*a* may correspond to a portion disposed approximately at a center of the upper surface of the cavity 11, and the second area 11*b* may correspond to a surrounding portion encircling the first area 11*a*. The first area 11*a* may be disposed further upward than the second area 11*b*, and a step may be formed between the first area 11*a* disposed upward and the second area 11*b* disposed downward.

Various types of electronic components may be disposed in the electronic component space 300, as described above. For example, a circuit board 31 is disposed in the electronic component space 30, as illustrated in FIG. 6. The circuit board 31 may be provided with various types of elements, a circuit and the like in relation to receipt of an operation signal, generation of a control signal for controlling an operation of the heating part and the like input through the control panel 20.

The circuit board 31, as illustrated in FIGS. 6 and 7, is disposed on the cavity 11 through a supporter 35. The supporter 35 supports the circuit board 31 while spacing the circuit board 31 from the cavity 11. For example, the supporter 35 may be disposed on the cavity 11, and the circuit board 31 may be coupled to the supporter 35 at a position where the circuit board 31 is spaced upward from the cavity 11. Accordingly, the circuit board 31 may be spaced a predetermined distance apart from the cavity 11.

The supporter 35 may include a support plate 36, an air guide 37, and a rear plate 38.

The support plate 36 may form a flat surface in parallel with the upper surface of the cavity 11. The support plate 36 may be spaced a predetermined distance from the upper surface of the cavity 11. An upper surface of the supporter 35 may be defined by the support plate 36. That is, the support plate 36 may form the upper surface of the supporter 35.

In the embodiment, the circuit board 31 may be mounted onto an upper surface of the support plate 36. The circuit board 31 may be accommodated in a board case 33, and the board case 33 may be coupled to the support plate 36 in a state where the board case 33 is mounted onto the upper surface of the support plate 36.

The board case 33 may have a plurality of coupling projections 34. Each of the coupling projections 34 may be provided in a way that protrudes to an outside of the board case 33 in a lateral direction of the board case 33. In a state where each coupling projection 34 describe above and the support plate 36 contact each other in the up-down direction, the coupling projection 34 and the support plate 36 may be coupled using a screw. Accordingly, the board case 33 and the support plate 36 may be coupled.

That is, the board case 33 may be fixed onto the upper surface of the support plate 36, and the circuit board 31 may be accommodated in the board case 33. Thus, the circuit board 31 may be fixed onto the upper surface of the support plate 36.

The air guide 37 may be disposed between a lower side of the support plate 36, i.e., the upper surface of the cavity 11, and the support plate 36. Additionally, the air guide 37 may be disposed in a lateral side of the circuit board 31. The air guide 37 may be formed into a flat surface in parallel with a side 11*c* of the cavity 11 and may form a side of the supporter 35.

According to the embodiment, the support plate 36 may have a length that is greater than a length of the circuit board 31 in the front-rear direction. The air guide 37 may have a length corresponding to the front-rear length of the support plate 36.

The air guide 37 may be coupled to the upper surface of the cavity 11, and the support plate 36. To this end, the air guide 37 may have a lower end coupling surface 37*a* and an upper end coupling surface 37*b*, respectively at a lower end and an upper end thereof.

The lower end coupling surface 37*a* may be disposed at the lower end of the air guide 37 and formed into a flat surface in parallel with the upper surface of the cavity 11. The upper end coupling surface 37*b* may be disposed at the upper end of the air guide 37, and may be formed into a flat surface in parallel with the support plate 36. For example, the lower end coupling surface 37*a* and the upper end coupling surface 37*b* may be formed in a way that a portion of an upper side of the air guide 37 and a portion of a lower side of the air guide 37 are bent.

The lower end coupling surface 37*a* may be coupled to the upper surface of the cavity 11 in a state where the lower end coupling surface 37*a* and the upper surface of the cavity 11 contact each other. The upper end coupling surface 37*b* may be coupled to the support plate 36 in a state where the upper end coupling surface 37*b* and a lower surface or the upper surface of the support plate 36 contact each other. The lower end coupling surface 37*a* and the cavity 11, and the upper end coupling surface 37*b* and the support plate 36 may be coupled through a screw coupling.

For example, the cavity 11, the air guide 37, and the support plate 36 may also be coupled in a way that the coupling projection 34, the support plate 36 and the upper end coupling surface 37*b* are coupled by a single screw at a time in a state where the coupling projection 34, the support plate 36 and the upper end coupling surface 37*b* overlap in the up-down direction.

As a result of coupling among the cavity 11, the air guide 37 and the support plate 36, the support plate 36 may be spaced from the upper surface of the cavity 11 by an approximate height of the air guide 37. Accordingly, the circuit board 31 supported by the support plate 36 may also be spaced from the upper surface of the cavity 11 by an approximate height of the air guide 37.

Additionally, the support plate 36 may be coupled to the front panel 13 disposed at the front thereof. For example, a portion of an upper end of the front panel 13 may be bent to form a coupling surface in parallel with the support plate 36, and a portion of the support plate 36 may protrude toward the front panel 13 to be coupled to the coupling surface of the front panel 13.

Like the air guide 37, the rear plate 38 may be disposed in the lower side of the support plate 36, i.e., between the upper surface of the cavity 11 and the support plate 36. Additionally, the rear plate 38 may be disposed at a rear of the circuit board 31. The rear plate 38 may be formed into a flat surface in parallel with a rear surface 11*d* of the cavity 11 and may form a rear surface of the supporter 35.

The rear plate 38 may be disposed between a below-described cooling fan 40 and the circuit board 31. The rear plate 38 may form a blocking wall that blocks between the cooling fan 40 and the circuit board 31. The rear plate 38 may also form a blocking wall that blocks a rear of a cool air passage 50.

Unlike the air guide 37 mounted onto the first area 11*a* of the upper surface of the cavity 11, the rear plate 38 may be mounted onto the second area 11*b* of the upper surface of the cavity 11. That is, the rear plate 38 may be disposed further upward than the air guide 37 and may protrude further upward than the air guide 37 and the circuit board 31. The rear plate 38 may be coupled to at least one of the air guide 37 and the support plate 36 and fixed to the rear of the circuit board 31.

The cool air passage 50 may be formed between the upper surface of the cavity 11, and the support plate 36 spaced apart from each other. The cool air passage 50 may be a space encircled by the upper surface of the cavity 11, the support plate 36 and the air guide 37. A front of the cool air passage 50 may be blocked by the front panel 13, and the rear of the cool air passage 50 may be blocked by the rear plate 38.

That is, an upper surface of the cool air passage 50 may be defined by the support plate 36, and a side of the cool air passage 50 may be defined by the air guide 37, and a front surface and a rear surface of the cool air passage 50 may be respectively defined by the front panel 13 and the rear plate 38.

The cool air passage 50, as illustrated in FIGS. 3 and 5, may connect to the inlet 14 formed on the front panel 13. That is, a passage for introducing air outside the cooking appliance into the cool air passage 50 may be formed on the front panel 13 by the inlet 14, as illustrated in FIGS. 5 to 7.

Further, an outlet 39 may be formed on the rear plate 38 and may penetrate in the front-rear direction. The cool air passage may connect to the outlet 39, and for the outlet 39, a passage for allowing air in the cool air passage 50 to pass through the rear plate 38 may be formed on the rear plate 38.

The cooling fan 40 may be disposed near the rear surface of the cavity 11 while disposed in the electronic component space 30. The cooling fan 40 may include a turbo fan disposed on the upper surface of the cavity 11. The cooling fan 40 may suction air at a front of the electronic component space 30 and discharge the air to a space at the rear of the cooking space 15.

Additionally, a lower through hole, communicating with the space at the rear of the cooking space 15 and being open forward, may be provided in a lower side of the front of the main body 10.

When the cooling fan 40 operates, external air in the lower side of the front of the main body 10 may be introduced into the door 16 through an air flow hole provided in a lower side of the door 16 and then may rise, as illustrated in FIG. 8. In this process, the door 16, heated by air delivered from the cooking space 15 to the door 16, may cool.

The air rising in the door 16 may be introduced into the electronic component space 30 through an air flow hole provided in an upper side of the door 16 and through the inlet 14 formed on the front panel 13 in a penetrating manner. The air introduced into the electronic component space 30 may be suctioned to the cooling fan 40, may cool electronic components in the electronic component space 30, may be discharged to the space at the rear of the cooking space 15, and then may be discharged to the front of the main body 10.

The air introduced into the electronic component space 30 through the inlet 14, i.e., most of the cool air, may pass through the cool air passage 50. The flow of the cool air may be induced by the air guide 37 disposed on the side of the cool air passage 50.

The air introduced into the cool air passage 50 may cool the electronic components such as the circuit board 31 supported by the supporter 35, may escape from the cool air passage 50 through the outlet 39 and may be suctioned into the cooling fan 40.

Referring to FIGS. 6 and 7, a space between the cool air passage 50 and the cooling fan 40 may be blocked by the rear plate 38, and a passage between the cool air passage 50 and the cooling fan 40 may be formed only by the outlet 39. Accordingly, cool air introduced into the cool air passage 50 may cool the circuit board 31 and the like while staying in the cool air passage 50 for a short period of time instead of immediately escaping from the cool air passage 50, and then may be discharged out of the cool air passage 50 through the outlet 39.

Thus, a temperature of the air introduced into the cool air passage 50 may be similar to a temperature of the air heat-exchanged with the circuit board 31 and the like, e.g., a temperature of the circuit board 31, rather than a temperature of the cool air before the introduction of the cool air into the inlet 14.

The cooking appliance according to the embodiment further includes a temperature measuring part 100. The temperature measuring part 100 is provided to measure temperatures of the electronic components disposed in the electronic component space 30. In the embodiment, the temperature measuring part 100 may be provided to measure a temperature of the circuit board 31.

[Disposition Structure of Temperature Measuring Part]

The temperature measuring part 100 is installed in the supporter 35 and supported by the supporter 35. The temperature measuring part 100 measures a temperature in the cool air passage 50 to indirectly measure the temperature of the circuit board 31. The temperature measuring part 100 may measure the temperature of the circuit board 31 as described above, and results of the temperature measuring part 100's measurement may be used as data for determining whether the cooling fan 40 operates.

In the embodiment, the temperature measuring part 100 may include a thermistor installed in the supporter 35 and configured to measure a temperature in the cool air passage 50.

The temperature measuring part 100 may be disposed between the upper surface of the cavity 11, and the circuit board 31. An up-down position of the temperature measuring part 100 may be between the upper surface of the cavity 11, and the circuit board 31. Additionally, a front-rear position of the temperature measuring part 100 may overlap a position of the circuit board 31.

Specifically, the temperature measuring part 100 may be installed in the air guide 37. The air guide 37 may be a component between the upper surface of the cavity 11, and the circuit board 31. Further, the air guide 37 may be a component disposed in lateral sides of the circuit board 31 and the cool air passage 50.

Since the temperature measuring part 100 is installed in the air guide 37, the temperature measuring part 100 may be disposed between the upper surface of the cavity 11, and the circuit board 31. Additionally, since at least a portion of the temperature measuring part 100 may protrude toward the cool air passage 50, the temperature measuring part 100 may be disposed at a position that overlaps the circuit board 31, and may be disposed in the cool air passage 50.

The disposition of the temperature measuring part 100 between the upper surface of the cavity 11 and the circuit board 31, and the disposition of the temperature measuring part 100 in the cool air passage 50 may produce the following results.

When cooking is performed in the coking space 15, a temperature in the cooking space 15 may rise due to heat generated by the heating part. Additionally, a temperature of the cavity 11 encircling an outside of the cooking space 15 may also rise. That is, when cooking is performed in the cooking space 15, the temperature of the cavity 11 may remain high.

Accordingly, when the temperature measuring part 100 contacts the cavity 11 or is disposed at a position very close to the cavity 11, the temperature of the cavity 11 may significantly affect results of the temperature measuring part 100's measurement of temperature. That is, a temperature measured by the temperature measuring part 100 may be almost similar to the temperature of the cavity 11.

Thus, since the results of the temperature measuring part 100's measurement may be greatly affected by the temperature of the cavity 11 regardless of whether cool air is passing through the cool air passage 50, it is difficult to determine whether the cooling fan 40 operates based on the results of the temperature measuring part 100's measurement.

When the cooking appliance described above operates, the circuit board 31 may generate heat during its operation. Accordingly, a temperature of the circuit board 31 may rise. Additionally, since heat generated through the cavity 11 may affect the temperature of the circuit board 31, the temperature of the circuit board 31 may rise while the cooking appliance operates.

Thus, when the temperature measuring part 100 contacts the circuit board 31 or is disposed at a position very close to the circuit board 31, the temperature of the circuit board 31 may significantly affect the results of the temperature measuring part 100's measurement of temperature. That is, a temperature measured by the temperature measuring part 100 may be almost similar to the temperature of the circuit board 31.

Thus, since the results of the temperature measuring part 100's measurement may be greatly affected by the temperature of the circuit board 31 regardless of whether cool air is passing through the cool air passage 50, it is difficult to determine whether the cooling fan 40 operates based on the results of the temperature measuring part 100's measurement.

Considering this, a position where the temperature measuring part 100 is disposed may be determined between the upper surface of the cavity 11, and the circuit board 31, and may be somewhat spaced apart from the cavity 11 and the circuit board 31.

In an example, the temperature measuring part 100 may be spaced the same distance respectively apart from the upper surface of the cavity 11 and the circuit board 31. In another example, considering the temperature of the cavity 11 higher than that of the circuit board 31, the temperature measuring part 100 may be disposed at a position closer to the circuit board 31 than to the upper surface of the cavity 11. In this case, certainly, the temperature measuring part 100 may not contact the circuit board 31 or may not be disposed at a position too close to the circuit board 31.

The front-rear position of the temperature measuring part 100 may be between the door 16 and the cooling fan 40, and may be disposed closer to the door 16 than to the cooling fan 40.

According to the embodiment, the cooling fan 40 may be disposed in the electronic component space 30, and disposed eccentrically to a rear of the electronic component space 30. That is, the cooling fan 40 may be disposed near the rear surface of the cavity 11.

The circuit board 31 may be disposed eccentrically to the front of the electronic component space 30. That is, the circuit board 31 may be disposed near the control panel 20. Since the control panel 20 is disposed at the front of the electronic component space 30, the circuit board 31 needs to be disposed eccentrically to the front of the electronic component space 30 to simplify a wire connection between the control panel 20 and the circuit board 31 and make the wire connection more efficient.

When the circuit board 31 is disposed eccentrically to the front of the electronic component space 30 as described above, i.e., when the circuit board 31 is disposed closer to the door 16 than to the cooling fan 4, the temperature measuring part 100 needs to be disposed closer to the door 16 than to the cooling fan 40. When the temperature measuring part 100 is disposed closer to the door 16 than to the cooling fan 40, the temperature measuring part 100 may effectively measure the temperature in the cool air passage 50 and may be designed to be fixed to the supporter 35.

As the temperature measuring part 100 becomes closer to the cooling fan 40, the temperature measuring part 100 may be more affected by the cooling fan 40 than by the temperature of the circuit board 31. That is, the results of the temperature measuring part 100's measurement may be more affected by whether the cooling fan 40 operates than by the temperature of the circuit board 31.

Additionally, when the temperature measuring part 100 is disposed near the cooling fan 40, it is difficult to install the temperature measuring part 100 in the supporter 35. To dispose the temperature measuring part 100 near the cooling fan 40, the front-rear length of the supporter 35 may excessively increase or an additional structure for fixing the temperature measuring part 100 needs to be added.

Considering this, the temperature measuring part 100 may be installed in the supporter 35, specifically, the air guide 37, and may be disposed closer to the door 16 than to the cooling fan 40 such that at least a portion of the temperature measuring part 100 is disposed in the cool air passage 50.

However, it is undesirable to dispose the temperature measuring part 100 too close to the door 16. While the door 16 is opened and closed, hot air in the cooking space 15 may be introduced into the electronic component space 30 through the inlet (14; see FIG. 15), and the hot air introduced may be a cause for distortion of the results of the temperature measuring part 100's measurement.

Accordingly, in the embodiment, while the temperature measuring part 100 is disposed between the inlet 14 and the cooling fan 40, the temperature measuring part 100 may be spaced a predetermined distance from the inlet 14 rearward.

The predetermined distance may be determined considering a scope of the effect of the hot air in the cooking space 15, which is introduced into the electronic component space through the inlet 14 during the opening and closing of the door 16.

For example, suppose that in the electronic component space 30, an area in a range of 10 mm from the inlet 14 in a rearward direction thereof undergoes a rapid increase in its temperature when the door 16 is opened and then closed. Then the predetermined distance may be set to 10 mm.

In the embodiment, the predetermined distance may be a distance (hereinafter, "circuit board spaced distance") between the upper surface of the cavity 11, and the circuit board 31 that are spaced from each other, or greater. For example, if the circuit board spaced distance is 10 mm, the predetermined distance may be set to 10 mm or greater.

This means that the temperature measuring part 100 needs to be spaced from the inlet 14 and that the temperature measuring part 10 needs to be spaced from the inlet 14 by at least the circuit board spaced distance.

Ordinarily, the circuit board 31 may be spaced from the cavity 11 to such an extent that heat of the cavity 11 does not directly affect the circuit board 31. Considering this, it may be assumed that an area spaced rearward from the inlet 14 by the circuit board spaced distance or greater is not directly affected by hot air that is introduced when the door 16 is opened and then closed.

Accordingly, in the embodiment, the temperature measuring part 100 may be spaced from the inlet 14 by the circuit board spaced distance or greater. Thus, the results of the temperature measuring part 100's measurement may not be affected by the hot air that is introduced when the door 16 is opened and then closed.

In another example, a scope of the effect of hot air in the cooking space 15, which is introduced into the electronic component space through the inlet 14 during the opening and closing of the door 16, may be actually measured, and based on results of the measurement, the predetermined distance may also be determined.

[Operation and Effect of Temperature Measuring Part]

Figure 9:
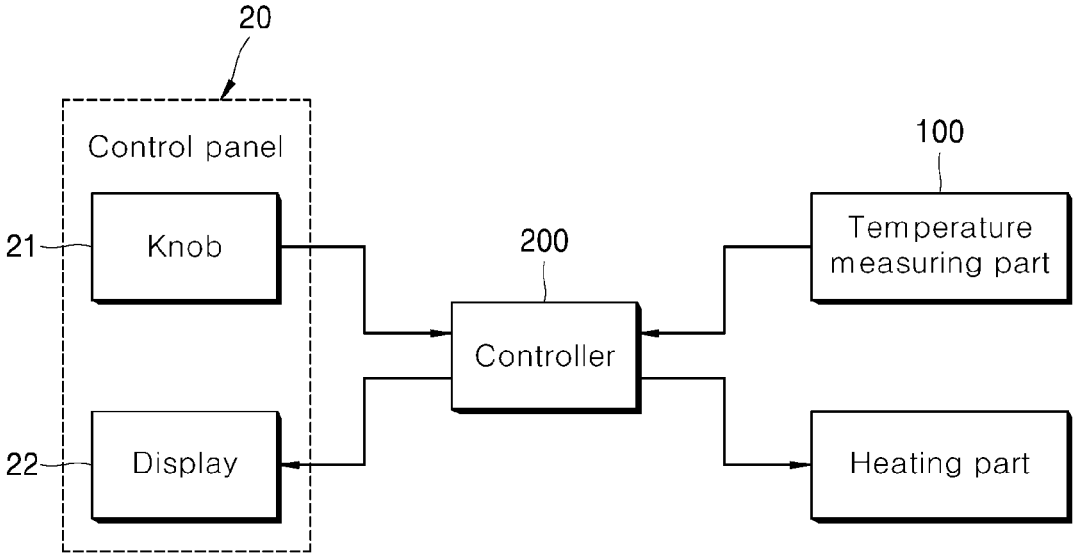
FIG. 9 is a block diagram schematically showing a configuration of a cooking appliance according to an embodiment.
Figure 10:
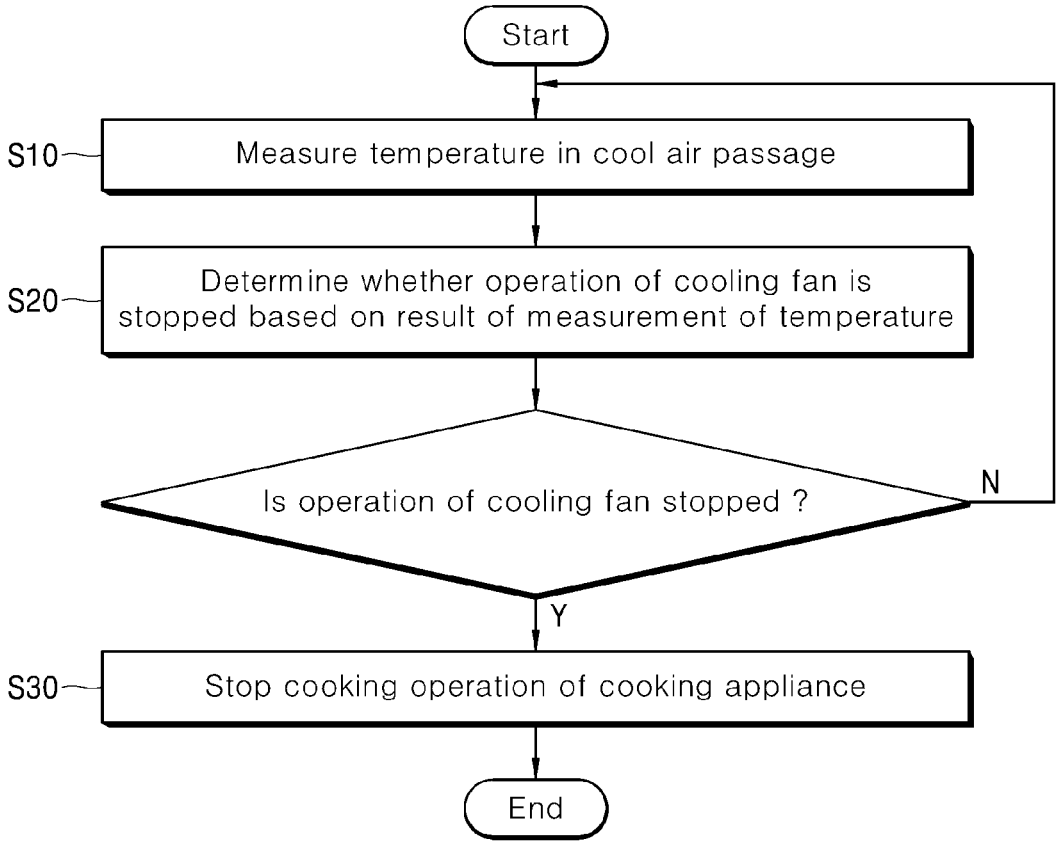
FIG. 10 is a flow chart showing a control process of a cooking appliance according to an embodiment.

FIG. 9 is a block diagram schematically showing a configuration of a cooking appliance according to an embodiment, and FIG. 10 is a flow chart showing a control process of a cooking appliance according to an embodiment.

The cooking appliance in the embodiment may include a controller 200, as illustrated in FIGS. 6 to 10. The controller 200 controls a cooking operation of the cooking appliance. For example, the controller 200 controls an operation of the heating part and the cooling fan 40 based on an operation signal input through the knob 21 of the control panel 20 and the like.

The controller 200 may also control an operation of the display 22 configured to display an operation state of the cooking appliance. In an example, the controller 200 may include a micro controller mounted onto the circuit board 31.

Additionally, the controller 200 stops a cooking operation of the cooking appliance when a temperature measured by the temperature measuring part 100 exceeds a predetermined temperature. Description in relation to this is described hereunder.

Ordinarily, while the cooking appliance performs a cooking operation, the heating part operates, and then the temperature of the cavity 11 and the circuit board 31 may gradually increase. The temperature of the circuit board 31 may increase due to heat generated as a result of operation of the circuit board 31 or due to the effect of heat of the cavity 11 on the circuit board 31.

While the heating part operates as described above, the cooling fan 40 may also operate. When the cooling fan 40 operates, external air in the lower side of the front of the main body 10 may be introduced through a lower side of the door 16, and then may be discharged through an upper side of the door 16 while cooling the door 16, and air discharged to the upper side of the door 16 may be introduced into the cool air passage 50 through the inlet 14 that is formed on the front panel 13 in a penetrating manner.

Cool air introduced into the cool air passage 50 cools the electronic components such as the circuit board 31 supported by the supporter 35 and the like, may escape from the cool air passage 50 through the outlet 39, may be suctioned into the cooling fan 40, may be discharged to the space at the rear of the cooking space 15 and then may be discharged to the front of the main body 10.

The space between the cool air passage 50 and the cooling fan 40 may be blocked by the rear plate 38, and a passage between the cool air passage 50 and the cooling fan 40 may be formed only by the outlet 39. Accordingly, cool air introduced into the cool air passage 50 may cool the circuit board 31 and the like while staying in the cool air passage 50 for a short period of time instead of immediately escaping from the cool air passage 50, and then may be discharged out of the cool air passage 50 through the outlet 39.

The temperature measuring part 100 measures a temperature of the air staying in the cool air passage 50. The temperature measuring part 100 may be installed in the supporter 35 defining the upper and lateral boundary surfaces of the cool air passage 50 and may measure a temperature in the cool air passage 50 (S10).

Results of the temperature measuring part 100's measurement is transmitted to the controller 200. The controller 200 determines whether the circuit board 31 is overheated based on the results transmitted by the temperature measuring part 100.

Specifically, the controller 200 may compare the results transmitted by the temperature measuring part 100 with a predetermined temperature, and when a temperature in the results transmitted by the temperature measuring part 100 exceeds the predetermined temperature, the controller 200 may determine that the circuit board 31 is overheated.

The predetermined temperature may be set to a highest temperature among temperatures that are measured by the temperature measuring part 100 while the cooling fan 40 operates. For example, the predetermined temperature may be set to the highest temperature that can be measure by the temperature measuring part 100 on the condition that the cooling fan 40 operates normally, a flow of cool air passing through the cool air passage 50 is normally guided, and the circuit board 31 cools properly by the cool air passing through the cool air passage 50.

When determining the temperature in the results transmitted by the temperature measuring part 100 exceeds the predetermine temperature, and as a result, the circuit board 31 is overheated, the controller 200 may determine that an operation of the cooling fan 40 is stopped (S20).

Since the predetermined temperature is set on the condition that the cooling fan 40 operates normally, it may be assumed that the operation of the cooling fan 40 is stopped due to failure of the cooling fan 40 when a temperature measured by the temperature measuring part 100 exceeds the predetermined temperature.

When determining the operation of the cooling fan 40 is stopped, the controller 200 stops a cooking operation of the cooking appliance (S30). Accordingly, the heating part may stop operating, and the circuit board 31 and components mounted onto the circuit board 31 may also stop operating.

When the cooking appliance continues to perform a cooking operation in a state where the cooling fan 40 stops operating, temperatures of the electronic components such as the circuit board 31 and the like may excessively increase. In this case, if left unchecked, the electronic components may fail. Additionally, it is undesirable to keep the cooking appliance performing a cooking operation when the cooling fan 40 is out of order.

In the embodiment, when it is determined that the cooling fan 40 is out of order, the cooking appliance stops a cooking operation. Accordingly, even when the electronic components do not cool properly due to the failure of the cooling fan 40, an excessive increase in the temperatures of the electronic components, or the failure of the same caused by the increase in the temperatures is prevented.

Further, the failure of the cooling fan 40 is determined based on the results of the temperature measuring part 100's measurement. Accordingly, the failure of the cooling fan 40 may be rapidly determined.

That is, the cooking appliance according to the embodiment rapidly determines whether the electronic components cool properly or not and may stop a cooking operation, when the electronic components do not cool properly due to the failure of the cooling fan 40, thereby preventing the electronic components from overheating and failing.

The embodiments are described above with reference to a number of illustrative embodiments thereof. However, it can be understood that numerous other modifications and embodiments can be devised by one skilled in the art without departing from the technical spirit of the disclosure. Thus, the protection scope of the technology in the present disclosure can be determined according to the appended claims.

DESCRIPTION OF SYMBOL

10: Main body
11: Cavity
11*a*: First area

11*b*: Second area
11*c*: Side
11*d*: Rear surface
13: Front panel
14: Inlet
15: Cooking space
16: Door
17: Handle
18: Convection part
20: Control panel
21: Knob
22: Display
25: Electronic component space cover
30: Electronic component space
31: Circuit board
33: Board case
34: Coupling projection
35: Supporter
36: Support plate
37: Air guide
37*a*: Lower end coupling surface
37*b*: Upper end coupling surface
38: Rear plate
39: Outlet
40: Cooling fan
50: Cool air passage
100: Temperature measuring part
200: Controller

What is claimed is:

1. A cooking appliance comprising:
a cavity including a cooking space therein;
an electronic component space provided outside the cooking space;
a circuit board disposed at the electronic component space;
a supporter to space the circuit board from the cavity and to support the circuit board;
a temperature measuring part disposed at the supporter and supported by the supporter; and
a cooling fan to generate a flow of air to pass through the electronic component space,
wherein the cooling fan generates the flow of air to pass through a cool air passage that is an area surrounded by the cavity, the circuit board and the supporter, and
the temperature measuring part measures a temperature in the cool air passage,
wherein the electronic component space is disposed at an upper side of the cooking space;
the supporter comprises an air guide disposed at a lateral side of the circuit board, configured to protrude upward from the cavity and configured to block a lateral side of the cool air passage; and
the temperature measuring part is disposed at the air guide,
wherein the temperature measuring part is disposed between the cavity and the circuit board, and a front-rear position of the temperature measuring part overlaps with a position of the circuit board.

2. A cooking appliance of claim 1, wherein the electronic component space is disposed at an upper side of the cooking space;
a door is disposed at a front of the cooking space;
the cooling fan is disposed at a rear of the cooking space; and
the temperature measuring part is disposed between the door and the cooling fan.

3. A cooking appliance comprising:
a cavity including a cooking space therein;
an electronic component space provided outside the cooking space;
a circuit board disposed at the electronic component space;
a supporter to space the circuit board from the cavity and to support the circuit board;
a temperature measuring part disposed at the supporter and supported by the supporter; and
a cooling fan to generate a flow of air to pass through the electronic component space,
wherein the cooling fan generates the flow of air to pass through a cool air passage that is an area surrounded by the cavity, the circuit board and the supporter, and
the temperature measuring part measures a temperature in the cool air passage,
wherein the electronic component space is disposed at an upper side of the cooking space;
a door is disposed at a front of the cooking space;
the cooling fan is disposed at a rear of the cooking space; and
the temperature measuring part is disposed between the door and the cooling fan,
wherein the temperature measuring part is disposed closer to the door than to the cooling fan.

4. The cooking appliance of claim 3, wherein the cooking appliance further comprises a front panel which is disposed between the cavity and the door, and at least a portion of the front panel blocks a front of the electronic component space and includes an inlet; and
the temperature measuring part is disposed between the inlet and the cooling fan and spaced rearward from the inlet by a predetermined distance.

5. The cooking appliance of claim 4, wherein the predetermined distance is a distance between the cavity and the circuit board spaced from each other, or greater.

6. The cooking appliance of claim 4, wherein the supporter is disposed between the inlet and the cooling fan.

7. The cooking appliance of claim 4, wherein the supporter comprises:
an air guide disposed at a lateral side of the circuit board, configured to protrude upward from the cavity and configured to block a lateral side of the cool air passage, and
a rear plate disposed at a rear of the circuit board and configured to block a rear side of the cool air passage.

8. The cooking appliance of claim 7, wherein the rear plate includes an outlet, and
air outside the electronic component space is introduced into the cool air passage through the inlet of the front panel, and
air passing through the cool air passage is allowed to pass through the rear plate through the outlet of the rear plate.

9. The cooking appliance of claim 8, wherein the outlet of the rear plate is configured to stall the air passing through the cool air passage prior to passing through the rear plate.

10. The cooking appliance of claim 1, wherein the cooking appliance further comprises a controller configured to control a cooking operation of the cooking appliance, and
the controller is configured to stop the cooking operation of the cooking appliance when the temperature measured by the temperature measuring part exceeds a predetermined temperature.

11. A cooking appliance comprising:

a cavity including a cooking space therein;

an electronic component space provided outside the cooking space;

a circuit board disposed at the electronic component space;

a supporter to space the circuit board from the cavity and to support the circuit board;

a temperature measuring part disposed at the supporter and supported by the supporter; and a cooling fan to generate a flow of air to pass through the electronic component space, wherein the cooling fan generates the flow of air to pass through a cool air passage that is an area surrounded by the cavity, the circuit board and the supporter, and the temperature measuring part measures a temperature in the cool air passage, wherein the cooking appliance further comprises a controller configured to control a cooking operation of the cooking appliance, and the controller is configured to stop the cooking operation of the cooking appliance when the temperature measured by the temperature measuring part exceeds a predetermined temperature, wherein the predetermined temperature is a highest temperature among temperatures that can be measured by the temperature measuring part during an operation of the cooling fan that indicates a failure of the cooling fan.

12. The cooking appliance of claim 1, wherein the temperature measuring part comprises a thermistor disposed at the supporter to measure the temperature in the cool air passage.

13. A control method for controlling a cooking operation of a cooking appliance including a cavity including a cooking space therein, an electronic component space provided outside the cooking space, a circuit board disposed at the electronic component space, a supporter to space the circuit board from the cavity and to support the circuit board, a temperature measuring part disposed at the supporter and supported by the supporter, and a cooling fan to generate a flow of air to pass through the electronic component space, wherein the cooling fan generates the flow of air to pass through a cool air passage that is an area surrounded by the cavity, the circuit board and the supporter, and the temperature measuring part measures a temperature in the cool air passage, comprising:

measuring, by the temperature measuring part, the temperature in the cool air passage;

determining, by a controller, whether the cooling fan has stopped operating based on a result of the measurement of the temperature in the cool air passage; and stopping the cooking operation of the cooking appliance, by the controller, when it is determined that the cooling fan has stopped operating.

14. The control method of claim 13, wherein the stopping of the cooking operation of the cooking appliance further comprises:

determining, by the controller, that the temperature measured by the temperature measuring part in the cool air passage has exceeded a predetermined temperature.

15. The control method of claim 14, wherein the predetermined temperature is a highest temperature among temperatures that can be measured by the temperature measuring part during an operation of the cooling fan that indicates a failure of the cooling fan.

16. The control method of claim 14, wherein the cooking appliance comprises a heating part to heat the cooking space, the method further comprises:

stopping an operation of the heating part, by the controller, when the temperature measured by the temperature measuring part exceeds the predetermined temperature, and it is determined that the cooling fan has stopped operating.

* * * * *